US012704337B2

(12) United States Patent
Krebs

(10) Patent No.: US 12,704,337 B2
(45) Date of Patent: Aug. 11, 2026

(54) FIREARM MAGAZINE RELEASE LEVER APPARATUS AND RELATED METHODS

(71) Applicant: Marc Krebs, Glenview, IL (US)

(72) Inventor: Marc Krebs, Glenview, IL (US)

( * ) Notice: Subject to any disclaimer, the term of this patent is extended or adjusted under 35 U.S.C. 154(b) by 0 days.

(21) Appl. No.: 19/091,552

(22) Filed: Mar. 26, 2025

(65) Prior Publication Data

US 2026/0168752 A1 Jun. 18, 2026

Related U.S. Application Data

(60) Provisional application No. 63/734,836, filed on Dec. 17, 2024.

(51) Int. Cl.
*F41A 17/38* (2006.01)
*F41A 3/72* (2006.01)

(52) U.S. Cl.
CPC ..... *F41A 17/38* (2013.01); *F41A 3/72* (2013.01)

(58) Field of Classification Search
CPC ..... F41A 17/38
See application file for complete search history.

(56) References Cited

U.S. PATENT DOCUMENTS 367,199 A * 7/1887 Diss ..... F41A 17/38 42/18
2,710,476 A * 6/1955 Garand ..... F41A 17/38 42/50
2,736,977 A * 3/1956 Harvey ..... F41A 17/38 42/6
2,765,558 A * 10/1956 Roper ..... F41A 17/38 42/50
2,829,563 A * 4/1958 Butler ..... F41A 19/32 42/25
2,900,878 A * 8/1959 Nomar ..... F41A 19/33 89/190
2,997,803 A * 8/1961 Florence ..... F41A 9/70 42/50
3,574,264 A * 4/1971 Simmons, Sr. ..... F41A 17/38 42/6
3,732,643 A * 5/1973 Wells ..... F41A 17/38 42/50
4,237,638 A * 12/1980 Trexler ..... F41A 11/02 42/6
5,771,620 A * 6/1998 Crawford ..... F41A 9/41 42/25
8,122,632 B2 * 2/2012 Bentley ..... F41A 9/72 42/6
8,418,390 B1 * 4/2013 Wright ..... F41A 17/38 42/49.01

(Continued)

*Primary Examiner* — Derrick R Morgan
(74) *Attorney, Agent, or Firm* — Fitch, Even, Tabin & Flannery, LLC

(57) ABSTRACT

A magazine release lever apparatus is provided having an engagement portion and a lever arm. The engagement portion is to engage a portion of an ammunition magazine to secure the ammunition magazine to the firearm. The lever arm extends from the engagement portion. The lever arm is pivotable about a pivot axis to move the engagement portion between a magazine securing position and a magazine release position. The lever arm is to be adjustably mounted to the firearm to permit adjustment of a position of the engagement portion relative to the pivot axis.

18 Claims, 18 Drawing Sheets

(56) References Cited

U.S. PATENT DOCUMENTS

| | | | | |
|---|---|---|---|---|
| 8,832,987 | B2 * | 9/2014 | Addis | F41A 9/64 42/49.01 |
| 8,959,818 | B2 * | 2/2015 | Mayerl | F41A 19/11 42/6 |
| 9,605,918 | B1 * | 3/2017 | Ballard | F41A 9/65 |
| 9,631,885 | B2 * | 4/2017 | Jones | F41A 9/24 |
| 9,766,029 | B2 * | 9/2017 | Dextraze | F41A 29/00 |
| 10,101,102 | B2 * | 10/2018 | Eitan | F41A 17/38 |
| 10,718,581 | B2 * | 7/2020 | Rieger | F41A 17/38 |
| 10,837,721 | B2 * | 11/2020 | Ives | F41A 11/02 |
| 2009/0288324 | A1 * | 11/2009 | Peterson | F41C 23/20 42/74 |
| 2010/0287806 | A1 * | 11/2010 | Marfione | F41A 35/06 42/7 |
| 2011/0232148 | A1 * | 9/2011 | Cain | F41A 17/38 42/6 |
| 2012/0255209 | A1 * | 10/2012 | Klassen | F41A 9/71 42/6 |
| 2014/0325886 | A1 * | 11/2014 | Mather | F41A 17/38 42/6 |
| 2015/0192384 | A1 * | 7/2015 | Ballard | F41A 9/70 42/71.01 |
| 2015/0345886 | A1 * | 12/2015 | Lavalley | F41A 17/38 42/6 |
| 2016/0258700 | A1 * | 9/2016 | Schafer | F41A 9/59 |
| 2017/0167814 | A1 * | 6/2017 | Larson, Jr. | F41A 35/06 |
| 2017/0219310 | A1 * | 8/2017 | Jones | F41C 23/16 |
| 2019/0033022 | A1 * | 1/2019 | Henninger | F41A 35/06 |
| 2020/0166302 | A1 * | 5/2020 | McCall | F41A 17/38 |
| 2024/0085130 | A1 * | 3/2024 | Ader | F41A 35/06 |

* cited by examiner

FIREARM MAGAZINE RELEASE LEVER APPARATUS AND RELATED METHODS

CROSS-REFERENCE TO RELATED APPLICATIONS

This application claims benefit of U.S. Provisional Application No. 63/734,836 filed Dec. 17, 2024, which is hereby incorporated herein by reference in its entirety.

FIELD

This disclosure relates to firearms and, in particular, magazine release mechanisms for firearms.

BACKGROUND

Firearms have magazine release mechanisms that are operable to release a magazine from the firearm, for example, to reload the magazine when empty or to swap in another loaded magazine. Some firearms such as an AK-47 rifle include a magazine release lever that catches a lug of a magazine to secure the magazine to the rifle. To release the magazine, the user pivots the lever until the lever no longer impedes movement of the lug of the magazine, which permits the magazine to be withdrawn from the rifle. When using such firearms, for example, in a competition, a user may need to replace their magazine as quickly as possible. Conventional magazine release levers are not ergonomic or designed for speed magazine changes.

Moreover, conventional magazine release levers may wear over time and need to be replaced to properly secure and release a magazine. Existing aftermarket magazine release levers are difficult and time consuming to install. For example, installation may require the user to make permanent alterations to the magazine release lever and/or their rifle (e.g., by grinding or filing) until the magazine release lever properly secures and releases magazines. Making such permanent alterations risks irreversibly damaging the rifle and/or the magazine release lever.

DETAILED DESCRIPTION

Figure 1A:
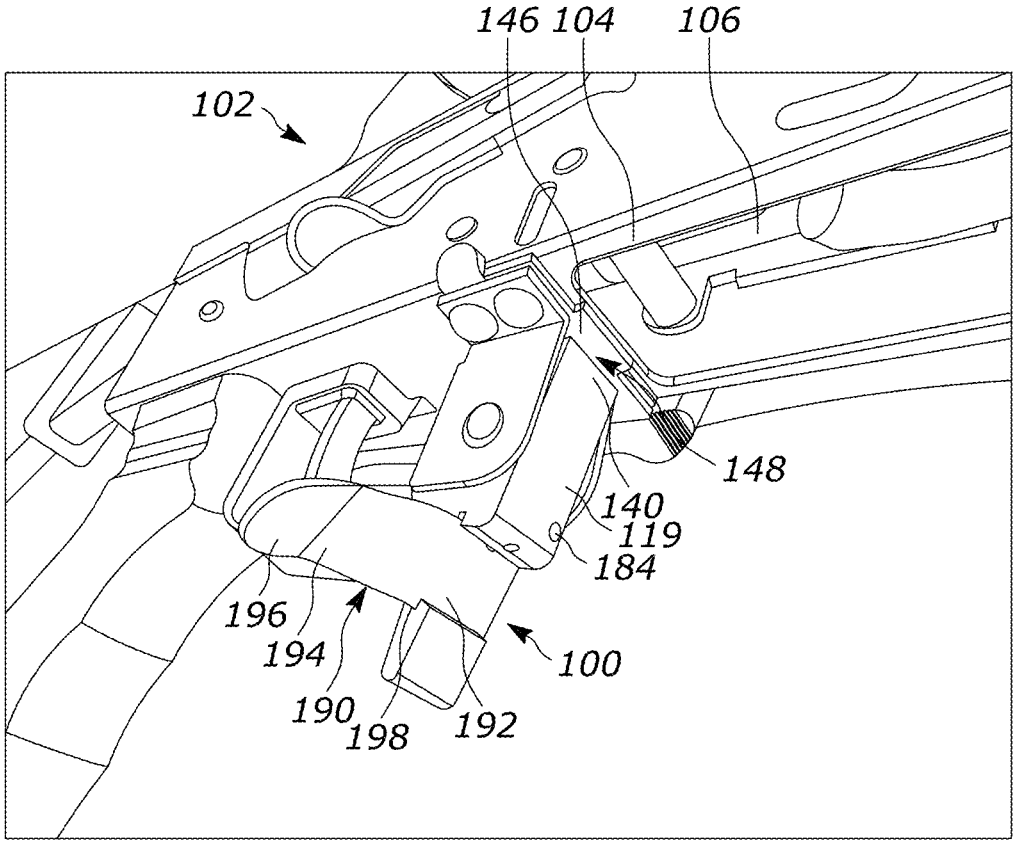
FIG. 1A is a front perspective view of a firearm including a magazine release assembly.
Figure 1B:
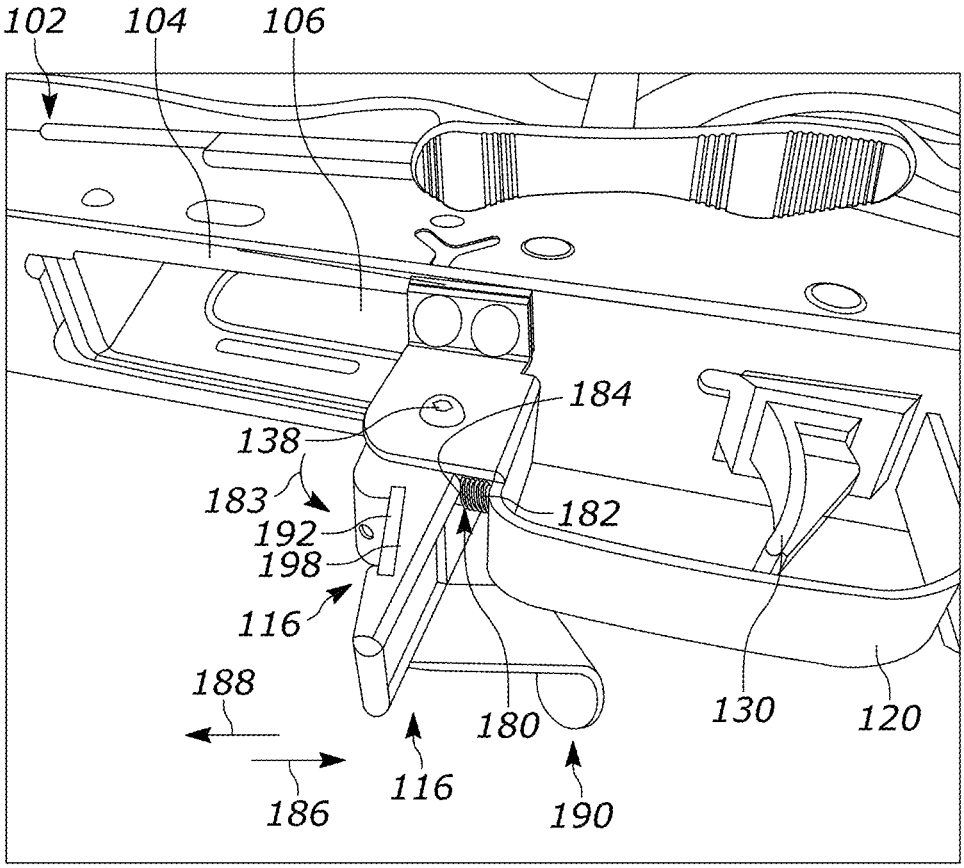
FIG. 1B is a rear perspective view of the firearm of FIG. 1B including the magazine release assembly.
Figure 2:
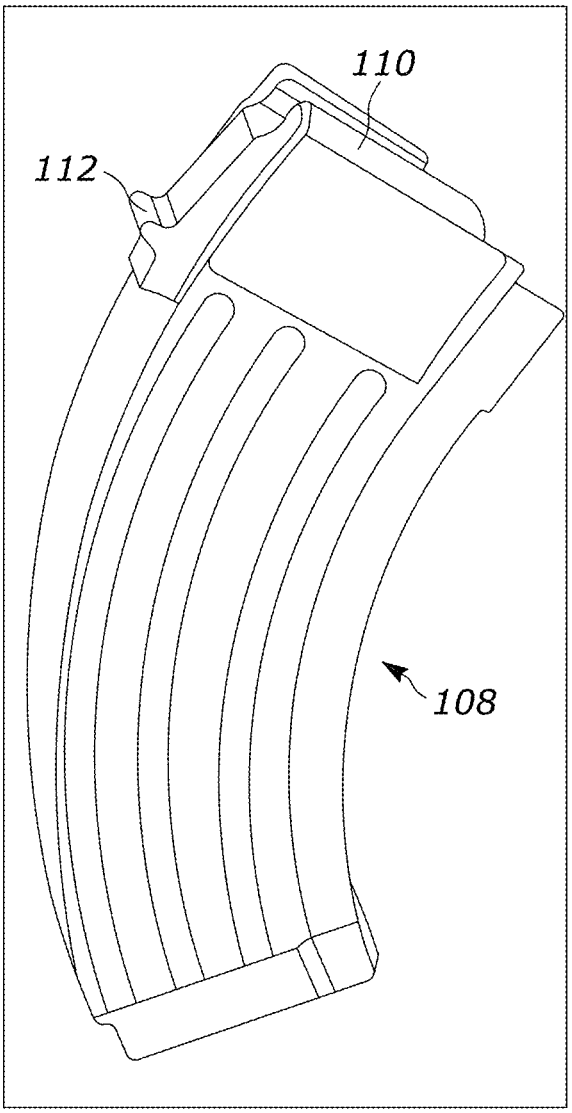
FIG. 2 is a magazine for the firearm of FIG. 1A.

With respect to FIGS. 1A and 1B, a magazine release assembly 100 is provided mounted to a firearm 102, such as a rifle (e.g., an AK-47). The firearm 102 has a receiver 104 including an opening 106 into which an ammunition storage and feeding device, such as a magazine 108 of FIG. 2, is releasably received. The magazine 108 includes a feeding end portion 110 that may be inserted into the opening 106 of the receiver 104 to feed ammunition rounds to the firearm 102 during use. The feeding end portion 110 of the magazine 108 includes a lug 112 which the magazine release assembly 100 engages to secure the magazine 108 to the firearm. The magazine release assembly 100 may be operated to disengage the lug 112 of the magazine to permit the magazine 108 to be removed from the firearm 102, for example, to be reloaded or to swap the magazine 108 with another magazine.

With reference to FIGS. 3A-3F, the magazine release assembly 100 is shown attached to a mounting bracket 114 that is disconnected from the firearm 102. The magazine release assembly 100 includes a release lever 116 pivotally connected to the mounting bracket 114. The mounting bracket 114 may be formed of a rigid material such as a metal (e.g., steel, aluminum, or brass) The mounting bracket 114 secures the magazine release assembly 100 to the receiver 104 of the firearm 102. The mounting bracket 114 may be a trigger guard of the firearm 102, such as a stock trigger guard. The mounting bracket 114 includes a lever support portion 118 and may include a trigger guard portion 120. In some forms, the lever support portion 118 and the trigger guard portion 120 are formed as a single piece. In some forms, the mounting bracket 114 does not include the trigger guard portion and the lever support portion 118 is configured to attach to or be mounted adjacent a trigger guard of the firearm 102.

The lever support portion 118 includes mounting flanges 122 and 124 that mount to the receiver 104 of the firearm 102 adjacent the opening 106. The mounting flange 122 may include one or more mounting holes 122A and the mounting flange 124 may include one or more mounting holes 124A. Fasteners (e.g., rivets, screws, bolts) may be extended through the mounting holes 122A, 124A and into the receiver 104 to secure the mounting bracket 114 to the receiver 104 of the firearm 102.

The trigger guard portion 120 includes an arm 126 and a mounting flange 128. The arm 126 extends from the lever support portion 118 to the mounting flange 128. The mounting flange 128 includes a mounting hole 128A through which a fastener (e.g., a rivet, screw, bolt) may be extended into the receiver 104 to secure the trigger guard portion 120 to the receiver 104 of the firearm 102. The arm 126 may extend about a trigger 130 (see FIG. 1B) (e.g. forming a partial loop) of the firearm 102 to inhibit unintentional contact with the trigger 130.

The lever support portion 118 is connected to and supports the release lever 116 to permit the release lever 116 to pivot relative to the mounting bracket 114. The lever support portion 118 includes a first side flange 132 spaced from a second side flange 134 to create a recess 136 (see FIG. 3C) to receive the release lever 116 therein. The first side flange 132 may include attachment openings through which one or more fasteners 138 (e.g., a rivet, a pivot screw, nut and bolt, etc.) may extend to pivotably mount the release lever 116 to the lever support portion 118.

Figure 3A:
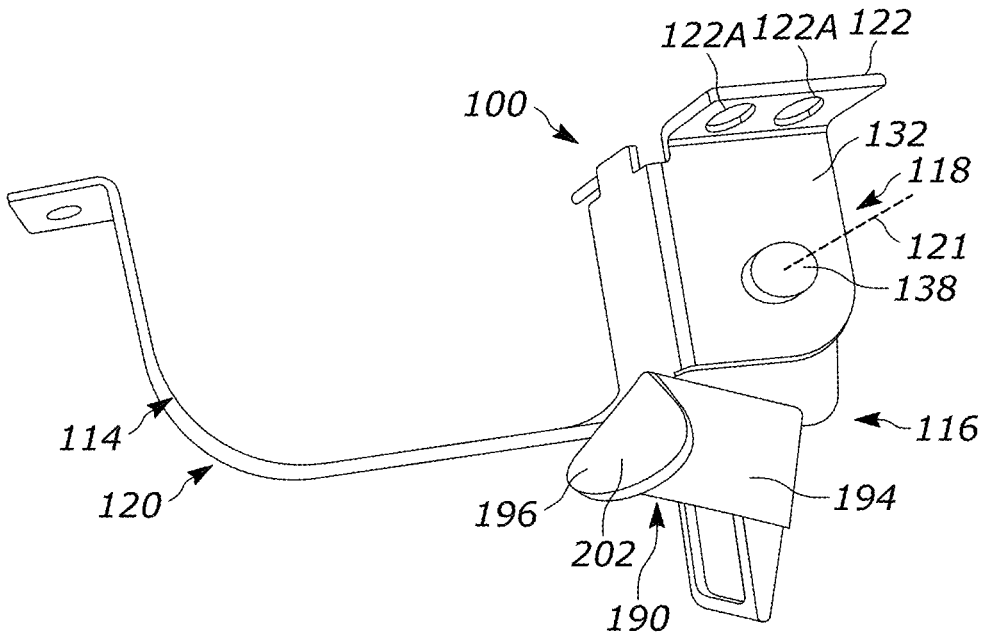
FIG. 3A is a right perspective view of the magazine release assembly of FIG. 1A mounted on a trigger guard of a firearm.
Figure 4:
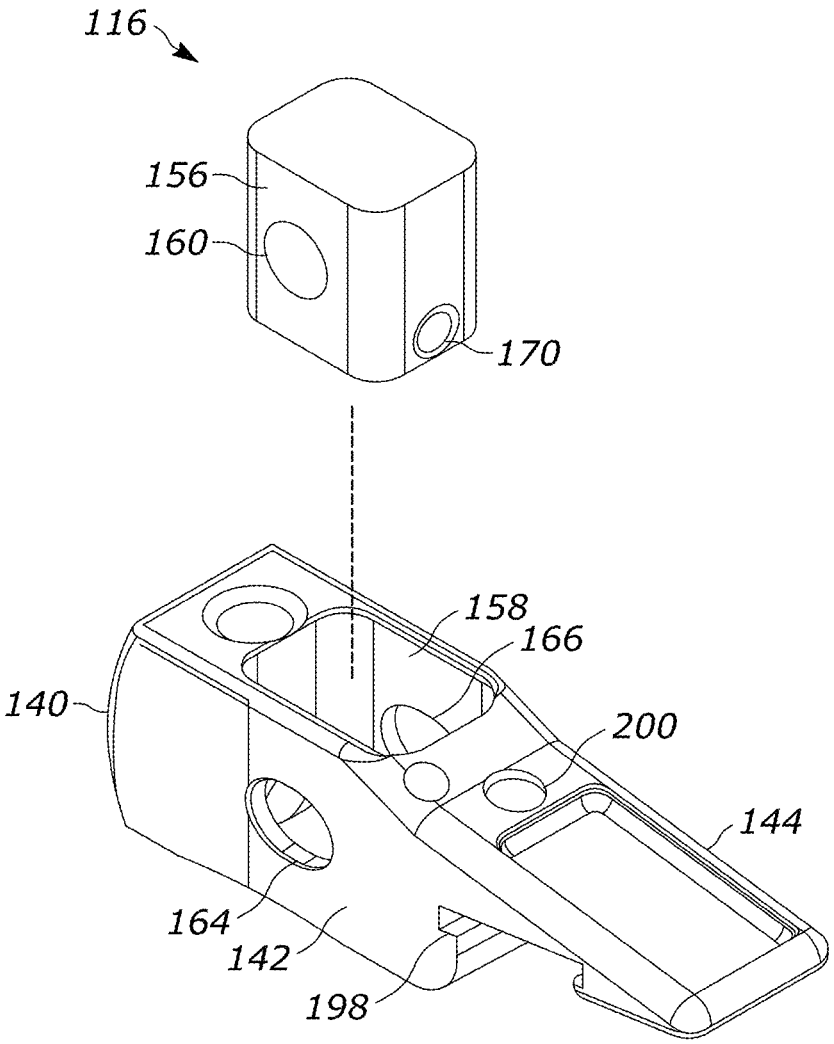
FIG. 4 is a perspective view of an adjustable lever arm of the magazine release assembly of FIG. 3A including a lever arm and an adjustment block.

With reference also to FIG. 4, the release lever 116 has a lever arm 119 that may be formed as a single piece. The lever arm 119 includes an engagement portion 140, a mounting portion 142, and an effort arm portion 144. The mounting portion 142 is pivotally connected to the mounting bracket 114 via the fasteners 138 such that the lever arm 119 is able to pivot about a pivot axis 121 (see FIG. 3A). The effort arm portion 144 is the portion of the lever arm 119 the user may engage to pivot the lever arm 119 as discussed below.

Figure 6:
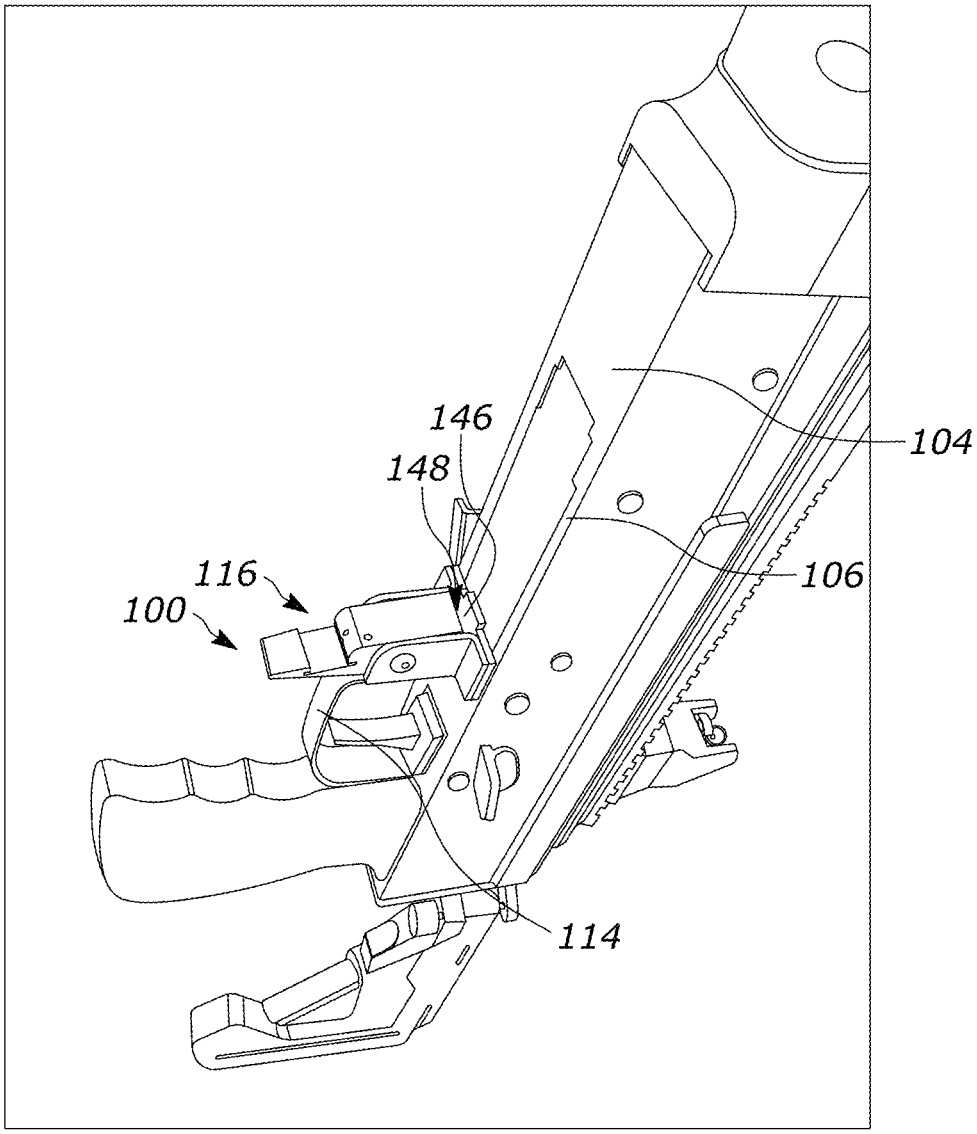
FIG. 6 is a bottom perspective view of the firearm including the magazine release assembly of FIG. 3A, illustrating the adjustable gap between the lever arm and a seating portion of the firearm.

The engagement portion 140 is supported adjacent a seating portion 146 of the receiver 104 of the firearm 102. The engagement portion 140 may be spaced from the seating portion 146 to form a space 148 (see FIGS. 1A and 6) to receive the lug 112 of the magazine 108 therein. The engagement portion 140 may include an engagement surface 141 that contacts the lug 112 to secure the lug 112 to the receiver 104. The engagement portion 140 is movable between a magazine securing position (see FIG. 7C) and a magazine release position (see FIG. 8A) by pivoting the lever arm 119 about the pivotal connection to the mounting bracket 114. In the magazine securing position, the engagement portion 140 of the lever arm 119 is positioned to contact the underside of the lug 112 (when a magazine is inserted into the receiver 104) to inhibit movement of the lug 112 away from the seating portion 146. In some forms, the engagement portion 140 is positioned to urge an upper side of the lug 112 against the seating portion 146, for example, to sandwich the lug 112 between the seating portion 146 and the engagement portion 140 of the lever arm 119. In the magazine release position, the engagement portion 140 is moved out of the path of the lug 112 (e.g., toward the trigger 130) to permit the lug 112 to move relative to the seating portion 146. When a magazine is inserted into the receiver 104, moving the engagement portion 140 to the magazine release position permits the magazine 108 to be withdrawn from the receiver 104. The engagement portion 140 may also be moved to the magazine release position to permit the magazine 108 to be inserted into the receiver 104. Once inserted, the engagement portion 140 may be moved to the magazine securing position to secure the magazine to the receiver 104.

The release lever 116 may include a biasing member such as a spring 150. The spring 150 may bias the engagement portion 140 toward the magazine securing position from the magazine release position. The spring 150 may be mounted to the lever arm 119 and extend to the arm 126 of the trigger guard portion 120. The spring 150 may be mounted adjacent the engagement portion 140 or above the mounting portion 142 of the lever arm 119. The spring 150 may apply a force to the lever arm 119 to push the lever arm 119 away from the trigger guard portion 120 toward the magazine securing position. A user may apply a force to the effort arm portion 144 (opposite the pivot axis 121 of the mounting portion) to counter the force of the spring 150 and urge the lever arm 119 toward the magazine release position.

The lever arm 119 also includes a loading surface 152 (see FIG. 3E) that the lug 112 of the magazine 108 may be pressed against and slid along when inserting the magazine into the receiver 104 of the firearm 102. The lug 112 may be pressed against the surface 152 to apply a force to the lever arm 119 counter to the biasing force of the spring 150. Upon application of sufficient force, the lever arm 119 is pivoted toward the magazine release position until the lug 112 is positioned against the seating portion 146 of the receiver 104 or in the space 148 adjacent the seating portion 146. With the lug 112 no longer pressing against the lever arm 119, the spring 150 urges the lever arm 119 back to the magazine securing position, with the engagement portion 140 under the lug 112 to secure the lug 112 (and thus the magazine 108) to the firearm 102. The engagement surface 141 of the lever arm 119 may extend from the loading surface 152. The engagement surface 141 may be curved as the engagement surface 141 extends from the loading surface 152 to facilitate movement of the lug 112 along the engagement surface 141 as the spring 150 urges the engagement portion 140 of the lever arm 119 toward the magazine securing position and under the lug 112.

The release lever 116 is mounted to the mounting bracket 114 such that the position of the lever arm 119 relative to the seating portion 146 of the receiver 104 is adjustable. For example, the lever arm 119 may be shifted toward or away from the seating portion 146 of the receiver 104 to adjust the size of the space 148 between the engagement portion 140 and the seating portion 146. For instance, when the magazine release lever assembly 100 is mounted to a firearm 102, the position of the lever arm 119 relative to the seating portion 146 of the receiver 104 may be adjusted to form a space 148 sized to receive the lug 112 of the magazine without having to grind, sand, or otherwise make permanent alterations to the firearm 102 or magazine release lever assembly 100.

To permit adjustment of the position of the lever arm 119 relative to the receiver 104, the release lever 116 includes an adjustment block 156 that is pivotally secured to the mounting bracket 114. The lever arm 119 is movably attached to the adjustment block 156 such that the position of the lever arm 119 relative to the adjustment block 156 may be adjusted. The lever arm 119 may move along the adjustment block 156 to shift the position of the lever arm 119 relative to the pivot axis 121 of the adjustment block 156. Regarding FIG. 4, the lever arm 119 includes a recess 158 sized to receive the adjustment block 156 therein. The recess 158 may have a shape corresponding to the adjustment block 156 to permit the adjustment block 156 to move (e.g., slide) in the recess 158 along the length of the lever arm 119 and maintain the orientation of the adjustment block 156 relative to the lever arm 119.

The adjustment block 156 includes an opening 160 by which the adjustment block 156 is pivotally secured to the mounting bracket 114. For example, the fastener 138 (e.g., pivot screw) extends through the opening 160 such that the adjustment block 156 is able to pivot about the fastener 138. The fastener 138 may include an axle portion 162 (see FIG.

3F) having a smooth outer surface about which the opening 160 of the adjustment block 156 rotates as the adjustment block 156 is pivoted. The size of the axle portion 162 may be substantially the same as the opening 160 of the adjustment block 156 to inhibit the adjustment block 156 from shifting substantially relative to the pivot axis 121 about the axle portion 162.

The lever arm 119 includes elongate openings or slots 164, 166 in the mounting portion 142 that extend into the recess 158 and are aligned with the opening 160 of the adjustment block 156. The fastener 138 (e.g., the axle portion 162) extends through the slots 164, 166 such that the fastener 138 is able to move along the length of the slots 164, 166 as the lever arm 119 moves relative to the adjustment block 156. In other words, the slots 164, 166 permit the lever arm 119 to be shifted along fastener 138, and thus shifted relative to the pivot axis 121.

The lever arm 119 may include an adjustment opening 168 (see FIG. 3F) that is aligned with an adjustment opening 170 of the adjustment block 156. An adjustment screw 172 (e.g., a worm screw) extends through the adjustment opening 170 of the adjustment block 156. The adjustment screw 172 includes threads 172A that engage threads 170A of the adjustment opening 170 of the adjustment block 156. A drive head 172B of the adjustment screw 172 is adjacent and accessible through the adjustment opening 168 (e.g., with a tool such as a screwdriver or hex key). The adjustment opening 168 is sized such that the adjustment screw 172 is not able to pass through the adjustment opening 168. For example, the diameter of the adjustment opening 168 is smaller than the outer dimension (e.g., a diameter) of the adjustment screw 172 and thus limits axial movement of the adjustment screw 172 in the lever arm 119. The lever arm 119 further includes an opening 204 that may be axially aligned with the adjustment opening 168. A set screw 206 is threaded in the opening 204 to retain the adjustment screw 172 in the lever arm 119 and limit axial movement of the adjustment screw 172. For example, the set screw 206 may be threaded in the opening 204 after inserting the adjustment screw 172 therethrough (e.g., when threading the adjustment screw 172 into the adjustment block 156 during assembly).

Figure 5A:
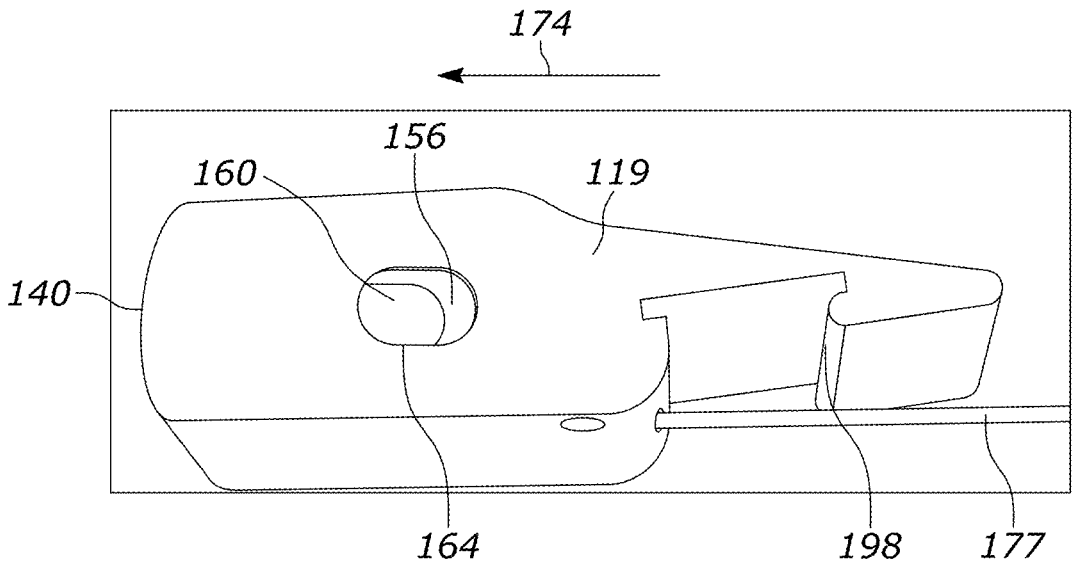
FIG. 5A is a side perspective view of the adjustable lever arm of the magazine release assembly of FIG. 3A with the adjustment block in a first position.
Figure 5B:
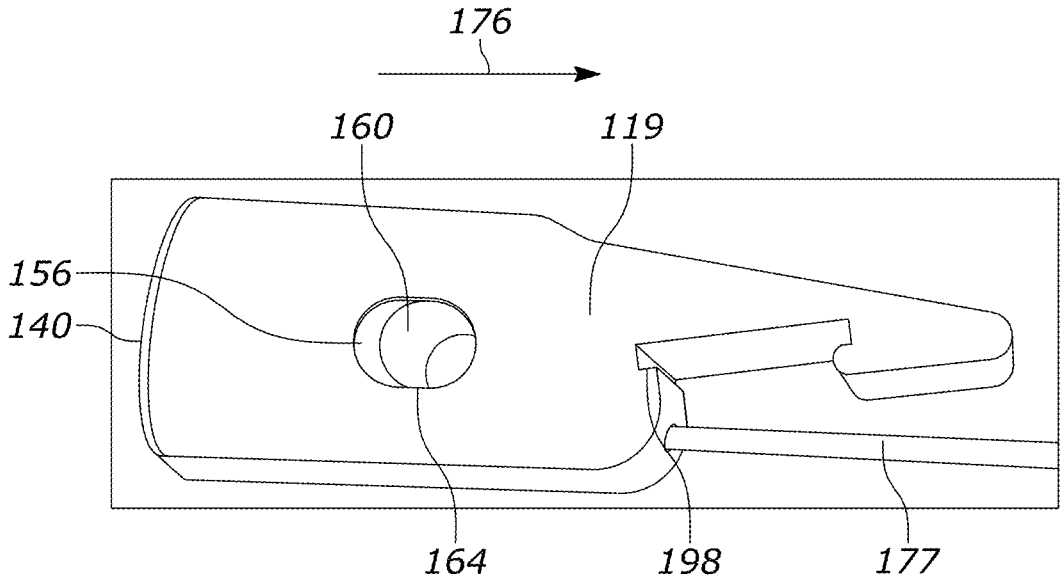
FIG. 5B is a side perspective view of the adjustable lever arm of the magazine release assembly of FIG. 3A with the adjustment block in a second position.

With reference also to FIGS. 5A and 5B, because axial movement of the adjustment screw 172 is limited by the adjustment opening 168 and the set screw 206, rotation of the adjustment screw 172 (e.g., using a tool to turn the drive head 172B) moves the adjustment block 156 relative to the lever arm 119. For example, rotation of the adjustment screw 172 causes the threads 172A of the adjustment screw 172 to engage the threads 170A of the adjustment block 156 which adjusts the position of the adjustment block 156 in the recess 158 of the lever arm 119. For example, the adjustment screw 172 may be rotated in a clockwise direction to move the adjustment block 156 in direction 174 (see FIGS. 3F and 5A) and rotated in a counterclockwise direction to move the adjustment block 156 in direction 176 (see FIG. 5B). The adjustment screw 172 may be rotated with a tool 177, such as a screwdriver or hex key. As shown, rotation of the adjustment screw 172 shifts the position of the adjustment block 156 in the lever arm 119, which shifts the lever arm 119 relative to the fastener 138 and the pivot axis 121. Adjusting the position of the lever arm 119 relative to the pivot point adjusts the distance between the engagement portion 140 of the lever arm 119 and the seating portion 146 of the receiver 104. As discussed above, the engagement portion 140 may be shifted toward or away from the seating portion 146 to adjust the size of the space 148 therebetween to a desired size, for example, sized to receive and secure the lug 112 of the magazine 108 therein. An adhesive (e.g., Loctite) may be applied to the threads of the adjustment screw 172 and/or adjustment opening 170 to fix the relative position of the adjustment block 156 and lever arm 119 once adjusted to the desired position. Adhesive (e.g., Loctite) may also be applied to the threads of the set screw 206.

Figure 3B:
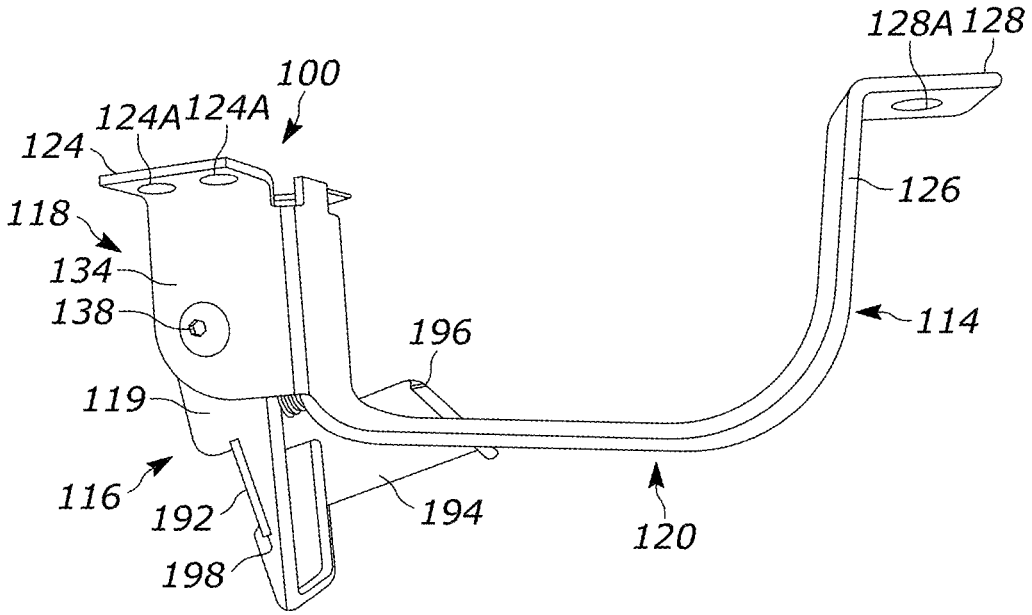
FIG. 3B is a left perspective view of the magazine release assembly and trigger guard of FIG. 3A.
Figure 3C:
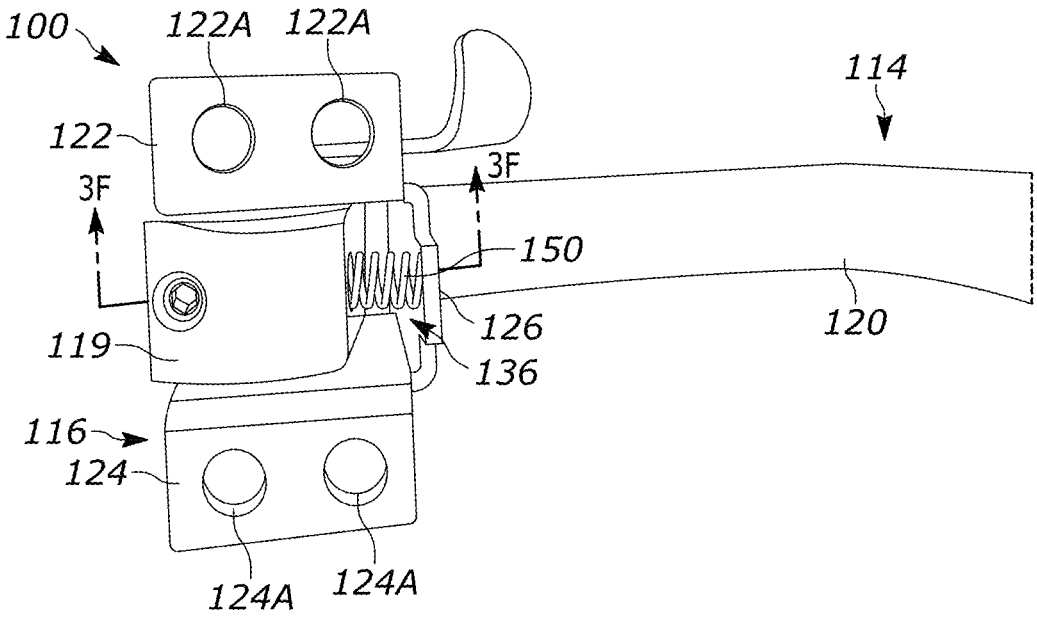
FIG. 3C is a top perspective view of the magazine release assembly and trigger guard of FIG. 3A.
Figure 3D:
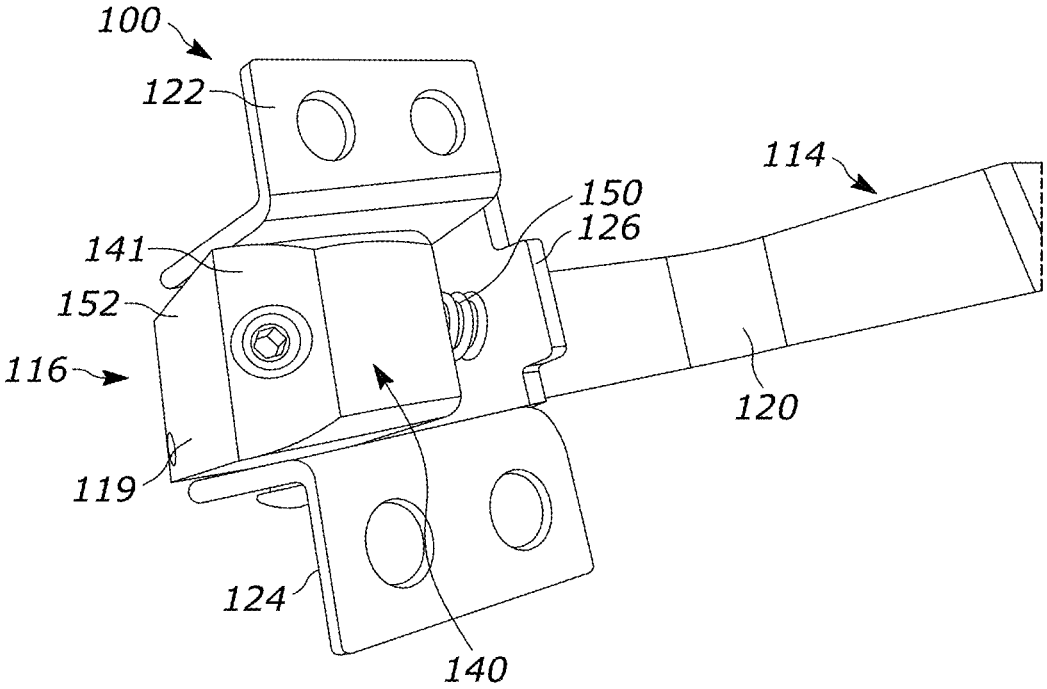
FIG. 3D is a front, top perspective view of the magazine release assembly and trigger guard of FIG. 3A.
Figure 3E:
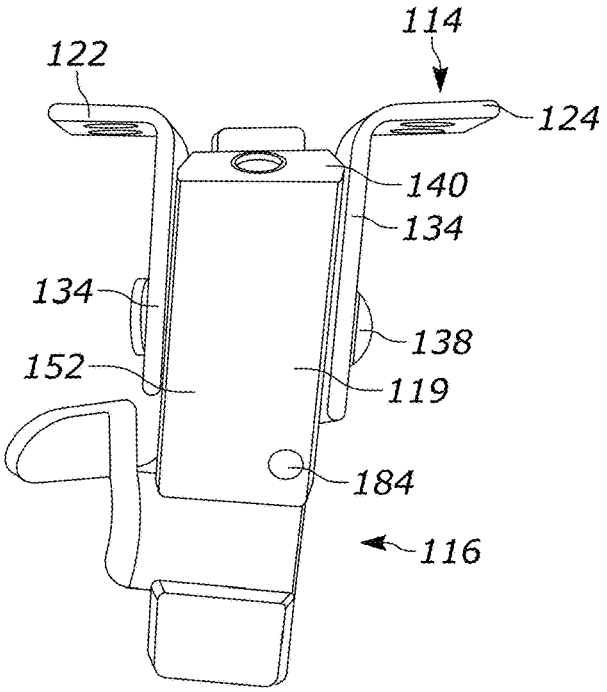
FIG. 3E is a front perspective view of the magazine release assembly and trigger guard of FIG. 3A.
Figure 3F:
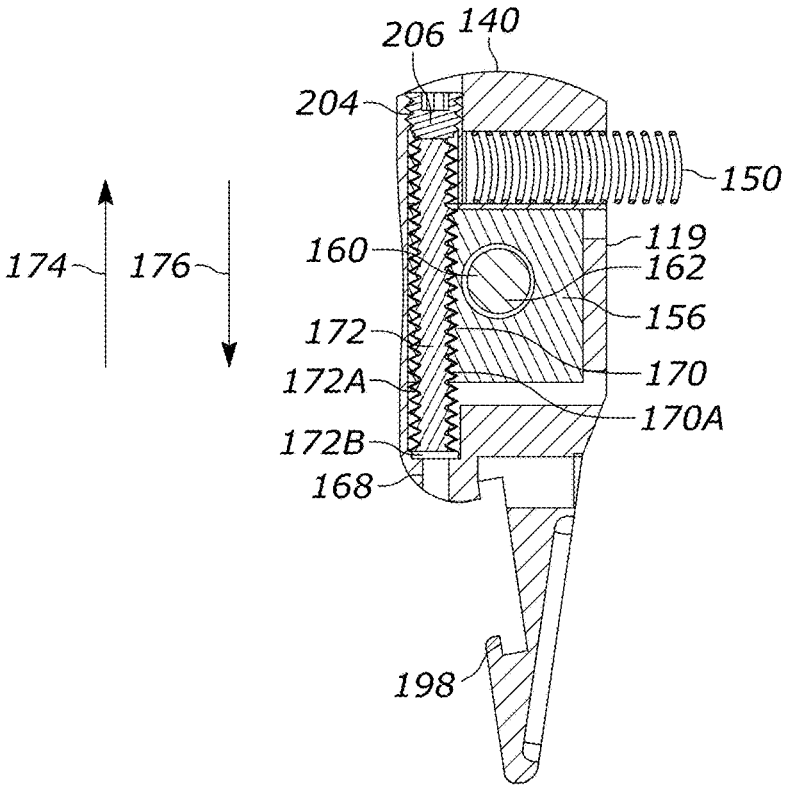
FIG. 3F is a cross-sectional view of the magazine release assembly of FIG. 3A taken along lines 3F-3F of FIG. 3C.

With reference to FIGS. 1B and 3E, the release lever 116 may further include pivot adjuster 180. The pivot adjuster 180 may be used to adjust an orientation of the lever arm 119 in a resting position, for example, when the spring 150 is biasing the lever arm 119 to the magazine securing position. The pivot adjuster 180 may be a stop that limits pivoting of the lever arm 119 about the fastener 138 in direction 183, for example, to limit how far the spring 150 is able to pivot the lever arm 119. The pivot adjuster 180 may thus be used to set the magazine securing position of the release lever 116. The pivot adjuster 180 may be operated to adjust the space between the trigger guard portion 120 and the effort arm portion 144 of the lever arm 119, which is on an opposite side of the mounting portion 142 of the lever arm 119 (and the pivot axis 121) from the spring 150.

The pivot adjuster 180 may include an adjustment screw 182 (e.g., a set screw) and a threaded opening 184 in the lever arm 119 to which the adjustment screw 182 is threaded. The adjustment screw 182 may protrude from the lever arm 119 toward the trigger guard portion 120 to space the lever arm 119 from the trigger guard portion 120. The threaded opening 184 may extend through the lever arm 119 to provide access to the adjustment screw 182 from the loading surface 152. A tool (e.g., a screwdriver or hex key) may be inserted in the threaded opening 184 through the loading surface 152 to rotate the screw 182. The adjustment screw 182 may be rotated to adjust the distance the adjustment screw 182 protrudes from the lever arm 119. For example, the adjustment screw 182 may be rotated in a clockwise direction to move the adjustment screw 182 in direction 186 (see FIG. 1B) to increase the space between the lever arm 119 and trigger guard portion 120 and rotated in a counterclockwise direction to move the adjustment screw 182 in direction 188 to decrease the space between the lever arm 119 and trigger guard portion 120. The adjustment screw 182 thus serves as a stop to limit pivoting movement of the lever arm 119 about the pivot axis 121. The adjustment screw 182 sets the orientation of the lever arm 119 when engaging and securing the lug 112 to the receiver 104. The orientation of the lever arm 119 may be adjusted to adjust the engagement of the engagement portion 140 and the lug 112, e.g., to ensure the magazine 108 is able to be smoothly attached and detached from the firearm 102. An adhesive (e.g., Loctite) may be applied to the threads of the adjustment screw 182 and/or threaded opening 184 to fix the position of the adjustment screw 182 once adjusted to the desired position.

In some forms, the release lever 116 also includes a pivot adjuster at the engagement portion 140 of the lever arm 119 to set the position of the lever arm 119 in the magazine release position. For example, the release lever 116 may similarly include a screw threaded to a threaded opening of the lever arm 119. The screw may protrude from the lever arm 119 toward the trigger guard portion 120 on the same side of the pivot point as the spring 150 to limit pivoting movement of the lever arm 119 against the biasing force of the spring 150. The screw may be rotated to increase or decrease the distance the screw protrudes from the lever arm 119. The screw may serve as a stop to limit movement of the lever arm 119 and inhibit over compressing of the spring 150.

With reference to FIGS. 1A and 3A-3B, the release lever 116 may include a lever extension 190. The lever extension 190 may be attached to the lever arm 119 and extend to a position that is easily accessible by the user. The lever extension 190 may extend in part toward the trigger 130 to enable a user to press the lever extension 190 to release the magazine 108 without having to take their hand off the firearm 102. For example, the user may use their trigger finger to press the lever extension 190 to release a magazine 108 without releasing their grip on pistol grip of the firearm 102. The lever extension 190 makes the release lever 116 ergonomic to operate and permits the user to quickly release the magazine 108, which may be beneficial in competitions where a user desires to quickly swap their magazine 108. For example, a right-handed shooter may keep their right hand on the pistol grip while actuating the release lever 116 with their trigger finger to release the magazine and use their left hand to insert a new magazine 108. By keeping their right hand in position on the firearm 102, the user is able to quickly replace the magazine 108 and be ready to fire the firearm 102 upon insertion of the magazine 108.

The lever extension 190 may include an attachment portion 192, an arm portion 194, and an engagement portion 196. The lever extension 190 may be formed of a single piece. The lever extension 190 may be formed of, for example, a metal such as steel. The attachment portion 192 attaches to the lever arm 119 such that when a user presses the engagement portion 196, the lever extension 190 causes the lever arm 119 to pivot. The attachment portion 192 may be attached to the effort arm portion 144 of the lever arm 119 such that pressing the lever extension 190 forward pivots the lever arm 119 against the biasing force of the spring 150. The effort arm portion 144 may include an attachment slot 198 sized to receive the attachment portion 192 therein. The attachment portion 192 of the lever extension 190 may be slid into the attachment slot 198 to connect the lever extension 190 to the lever arm 119. The effort arm portion 144 may include a threaded opening 200 (see FIG. 4) into which a fastener (e.g., a screw) may be extended to frictionally engage the attachment portion 192 of the lever extension 190 to secure the lever extension 190 to the lever arm 119. The fastener may be tightened to secure the lever extension 190 to the lever arm 119 and may be untightened to release the lever extension 190 from the lever arm 119 (e.g., to replace the lever extension 190).

When the attachment portion 192 of the lever extension 190 is secured to the lever arm 119, the arm portion 194 of the lever extension 190 extends in part toward the rear of the firearm 102 to support the engagement portion 196 of the lever extension 190 proximate to the trigger 130. The engagement portion 196 may extend outward of the firearm 102 from the arm portion 194 to provide an engagement surface 202 against which the user can press to pivot the release lever 116. The engagement surface 202 may include grip features, such as stippling or cross-hatching, to increase the friction of the surface the user engages when pressing the lever extension 190. For example, the grip features inhibit the user's finger from slipping on the lever extension 190 as the user presses the lever extension 190.

In the form shown, the lever extension 190 extends to the right side of the firearm 102 next to the trigger guard portion 120. This lever extension 190 is designed for use by right-handed shooters to enable them to use their trigger finger to press on the engagement portion 196 of the lever extension 190 to release the magazine 108 without removing their hand from the pistol grip of the firearm 102. In other forms, the lever extension 190 extends to the left side of the firearm 102 to enable lefthanded shooters to user their trigger finger to press on the engagement portion 196 without removing their hand from the pistol grip of the firearm 102. In some forms, the lever extension 190 includes two arm portions 194 extending from opposite sides of the attachment portion 192 to support engagement portions 196 on both the left and right sides of the firearm 102 to provide an ambidextrous magazine release assembly operable from both the left and right sides of the firearm 102 (e.g., with the right hand index finger when right-handed shooting and with the left hand index finger when lefthanded shooting).

Additionally or alternatively, to release the magazine, a user may apply force to the effort arm portion 144 to pivot the release lever 116. For example, a user may grip the magazine with their non-trigger hand and use their thumb to apply force to the release lever 116 to enable the user to withdraw the magazine from the firearm 102. The magazine release assembly 100 may thus be operated ambidextrously such that the user can use either their right or left hand to release the magazine 108 regardless of which hand the user uses to pull the trigger 130. In some forms, the lever extension 190 may be omitted from the magazine release assembly 100 such that the user directly engages the lever arm 119 to release the magazine.

Figure 7A:
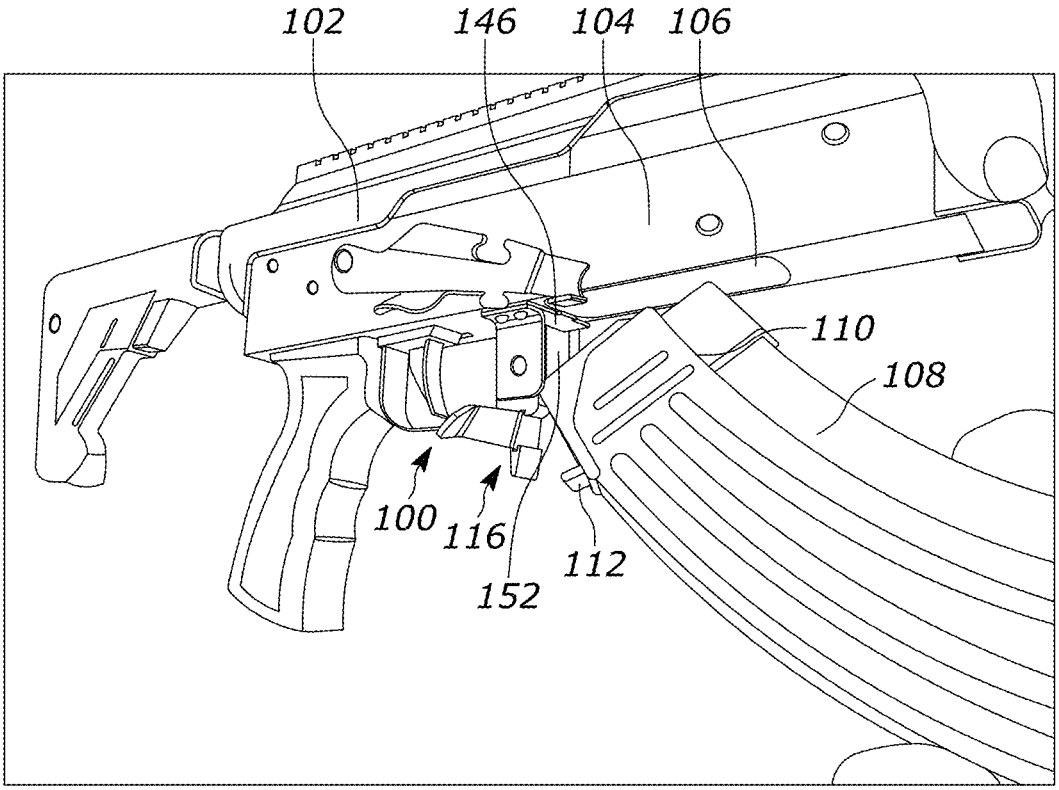
FIGS. 7A-7C illustrate attachment of the magazine of FIG. 2 to the firearm using the magazine release assembly of FIG. 3A.
Figure 7B:
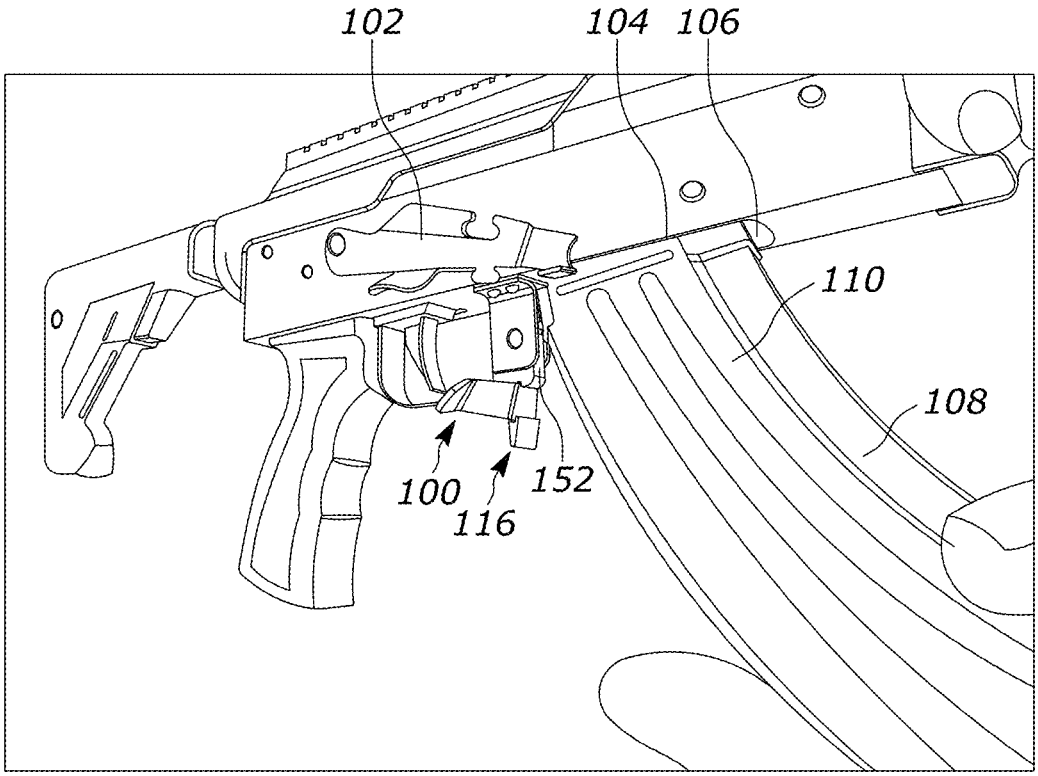
Figure 7C:
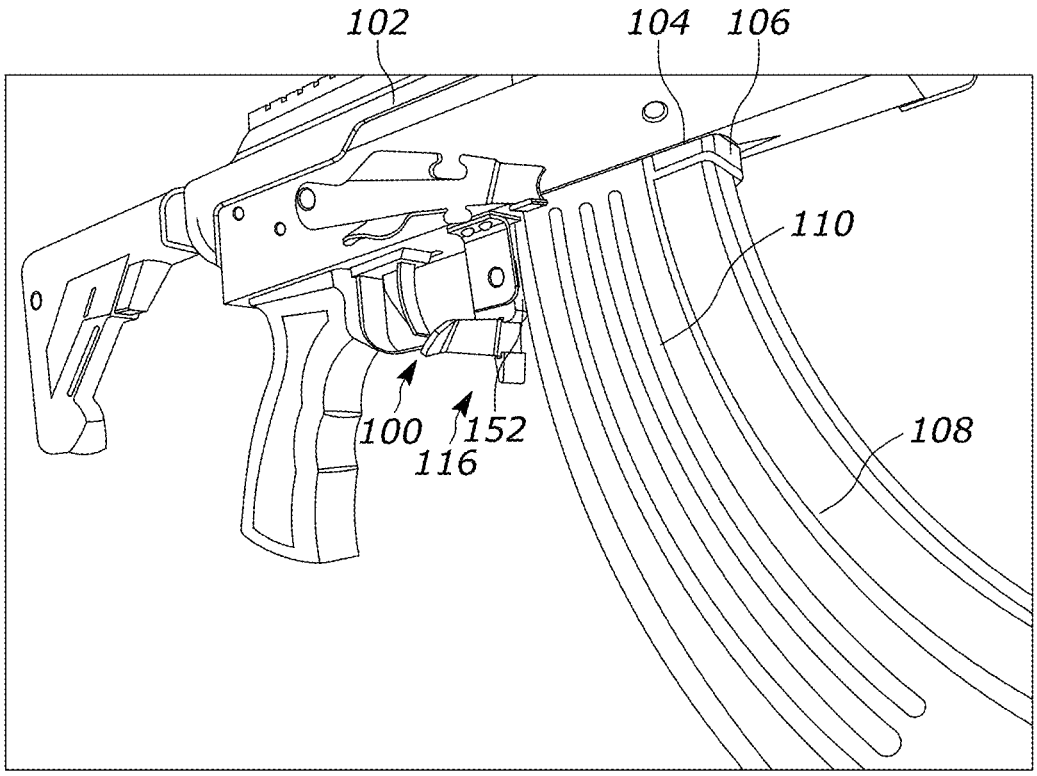

With reference to FIGS. 7A-7C, a method of attaching a magazine 108 to the firearm 102 is provided. As shown in FIG. 7A, the feeding end portion 110 of the magazine 108 is brought near the receiver 104 of the firearm and aligned with the opening 106. The feeding end portion 110 may then be inserted into the opening 106 of the receiver 104 and the lug 112 of the magazine 108 pressed against the loading surface 152 as shown in FIG. 7B. Pressing the lug 112 against the loading surface 152 causes the release lever 116 to pivot against the biasing force of the spring 150 toward the magazine release position. The magazine 108 may be urged into the opening 106 of the receiver 104 until the lug 112 passes beyond the end of the lever arm 119 as in FIG. 7C. Upon the lug 112 passing beyond the lever arm 119, the spring 150 urges the lever arm 119 toward the magazine securing position, with the engagement portion 140 of the lever arm 119 underneath the lug 112. With the lug 112 between the seating portion 146 of the receiver and the engagement portion 140 of the lever arm 119, the magazine 108 is secured to the firearm 102.

Figure 8A:
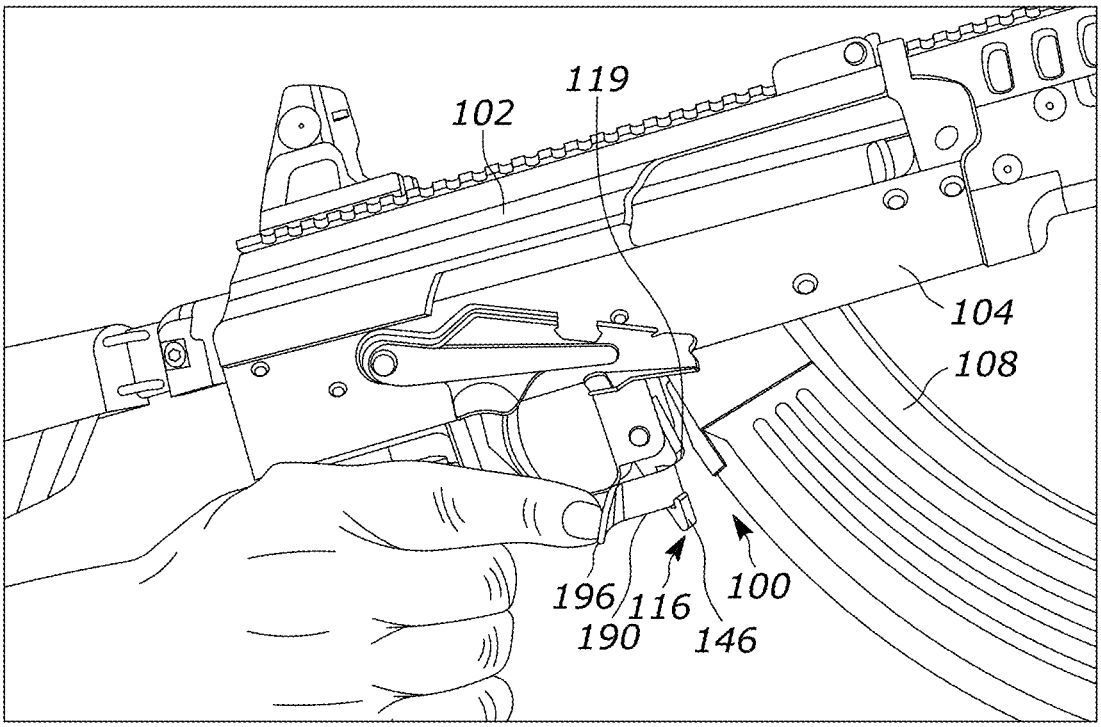
FIGS. 8A-8B illustrate release of the magazine of FIG. 2 from the firearm using the magazine release assembly of FIG. 3A.
Figure 8B:
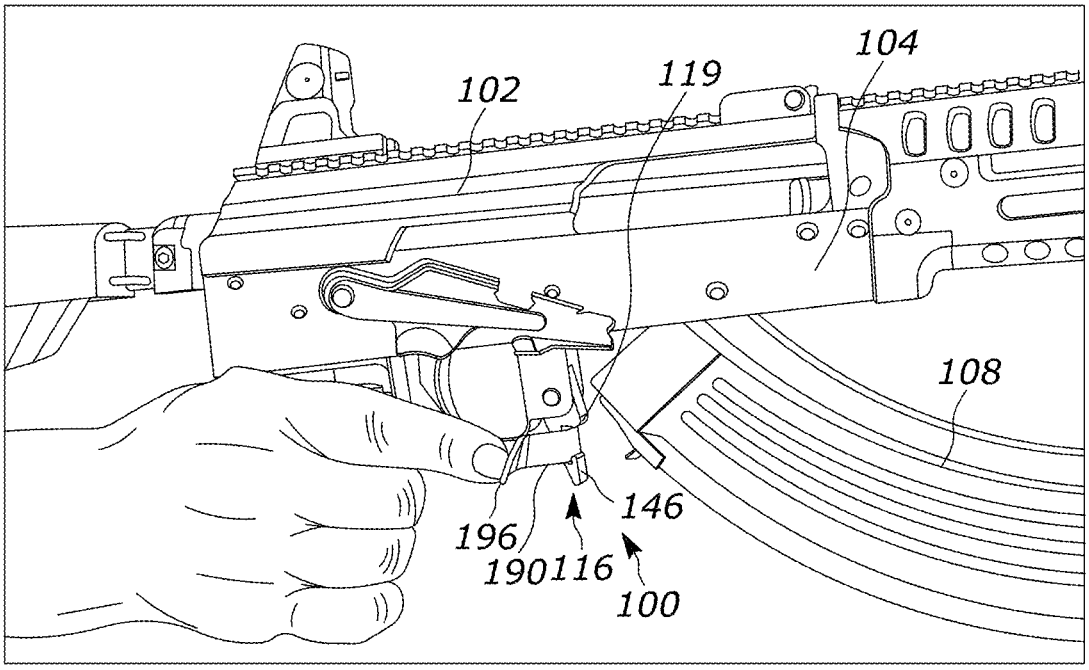

With reference to FIGS. 8A-8B, a method of releasing the magazine 108 from the firearm 102 is provided. As shown in FIG. 8A, the user may press on the engagement portion 196 of lever extension 190 to urge the effect arm portion 146 of the lever arm 119 forward and pivot the lever arm 119 about the pivot axis 121. Alternatively, the user may press on the effort arm portion 144 of the lever arm 119 to cause the lever arm 119 to pivot about the pivot axis 121 (e.g., where the lever extension 190 is not used or included). Pivoting the lever arm 119 causes the engagement portion 140 of the lever arm 119 to be moved rearward and out of the pathway of the lug 112 of the magazine 108. As shown in FIG. 8B, with the lever arm 119 no longer securing the lug 112 to the receiver 104 of the firearm 102, the magazine 108 is able to be withdrawn from the receiver 104, e.g., by gravity or a user pulling the magazine downward and out of the opening 106 of the receiver 104.

Figure 9:
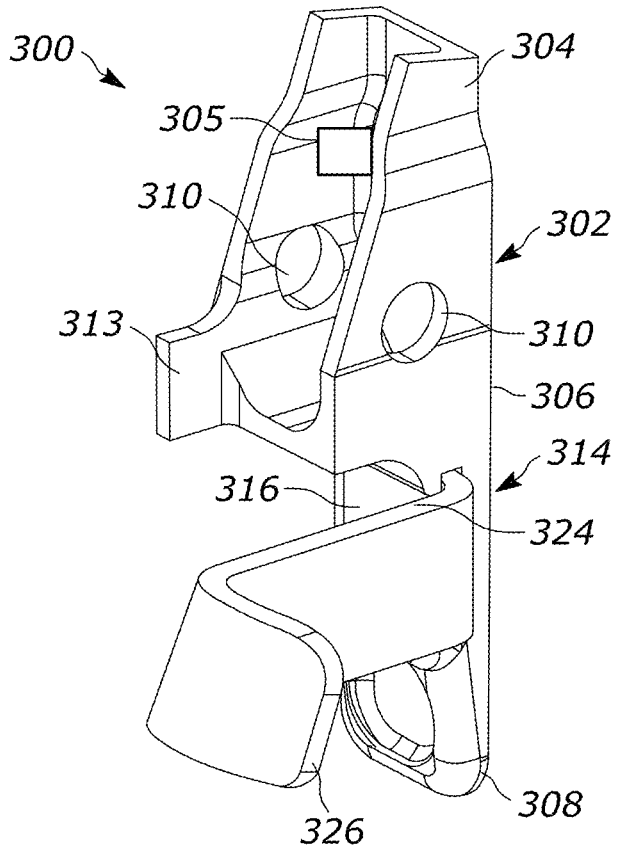
FIG. 9 is a release lever of a magazine release assembly according to another embodiment.
Figure 10A:
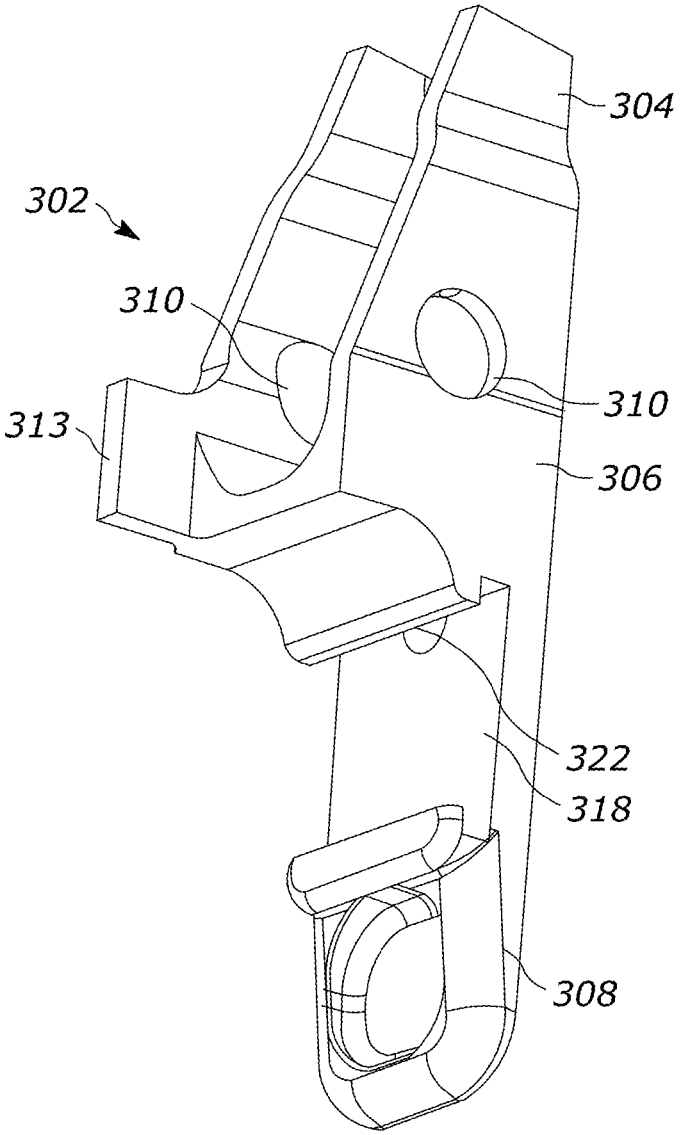
FIG. 10A is a bottom perspective view of a lever arm of the release lever of FIG. 9.
Figure 10B:
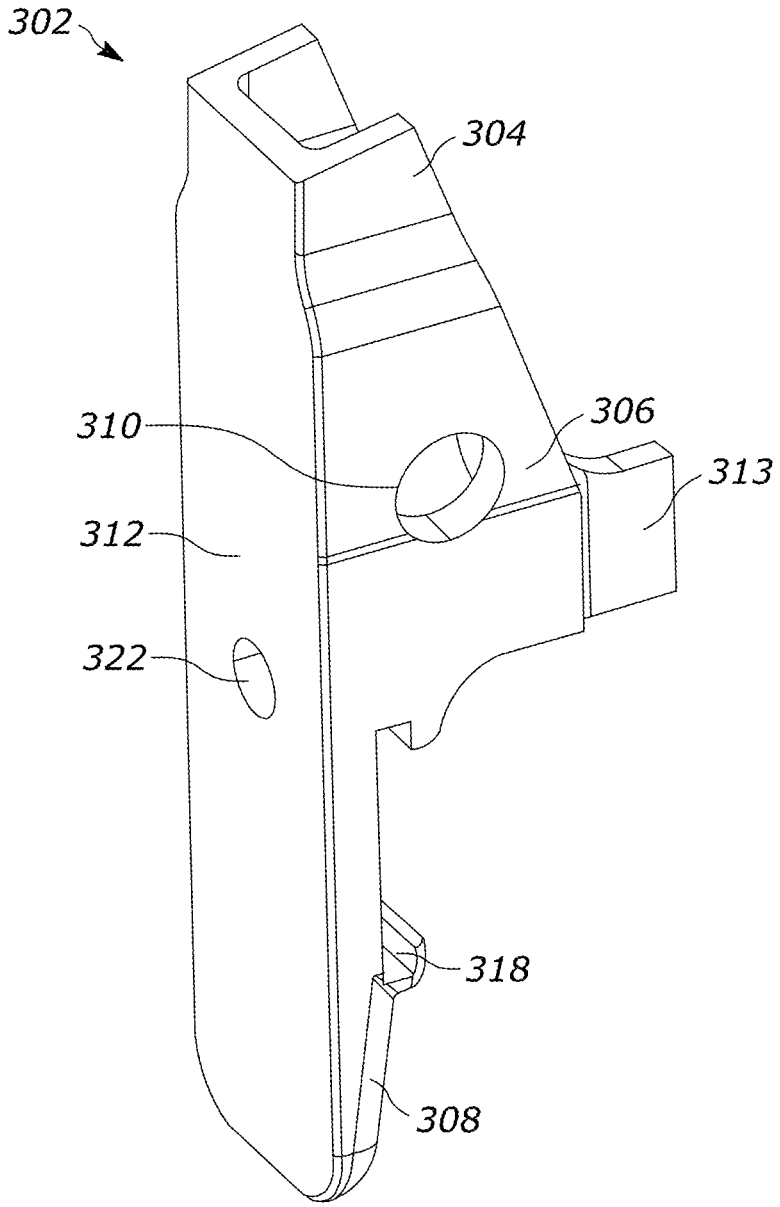
FIG. 10B is a top perspective view of the lever arm of FIG. 10A.
Figure 11:
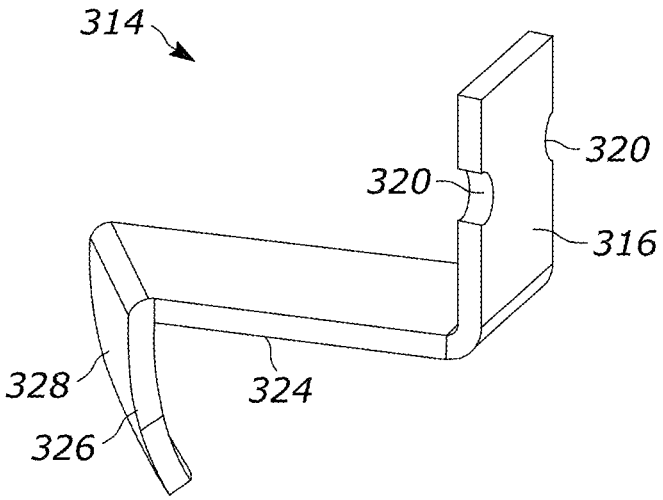
FIG. 11 is a perspective view of a lever extension of the release lever of FIG. 9.

With reference to FIGS. 9-11, a release lever 300 is provided according to another embodiment. The release lever 300 may be used with the magazine release assembly 100 discussed above, for example, in place of the release lever 116. The release lever 300 is similar in many respects to the release lever 116 such that the differences are primarily highlighted.

The release lever 300 has a lever arm 302 that may be formed as a single piece. The lever arm 302 includes an engagement portion 304, a mounting portion 306, and an effort arm portion 308. The mounting portion 306 includes attachment openings 310 by which the lever arm 302 may be pivotally connected to the mounting bracket 114. The effort arm portion 308 is the portion of the lever arm 302 the user may engage to pivot the lever arm 302 as discussed below.

The engagement portion 304 is supported adjacent the seating portion 146 of the receiver 104 of the firearm 102. The engagement portion 304 is spaced from the seating portion 146 to form a space to receive the lug 112 of the magazine 108 therein. The lever arm 302 may be biased to position the engagement portion 304 in a magazine securing position where the engagement portion 304 contacts the lug 112 to secure the lug 112 to the receiver 104. The lever arm 302 may be pivoted to a magazine release position to move the engagement portion 304 out of contact with the lug 112 to permit the magazine 108 to be removed from the firearm 102. The release lever 300 may include a biasing member 305 such as a spring to bias the engagement portion 304 toward the magazine securing position from the magazine release position. A user may apply a force to the effort arm portion 308 to counter the force of the biasing member 305 and urge the lever arm 302 toward the magazine release position.

The lever arm 302 also includes a loading surface 312 that the lug 112 of the magazine 108 may be pressed against and slid along when inserting the magazine into the receiver 104 of the firearm 102. The loading surface 312 may be a flat surface to guide movement of the lug 112 therealong. The lug 112 may be pressed against the surface 312 to apply a force to the lever arm 302 counter to the biasing force of the biasing member 305 to move the lever arm 302 to the magazine release position temporarily until the lug 112 is received in between the seating portion 146 of the firearm 102 and the engagement portion 304, at which point the biasing member 305 urges the lever arm 302 to the magazine securing position with the engagement portion 304 in contact with the lug 112.

The mounting portion 306 may include a stop 313 to limit pivotal movement of the lever arm 302 from the biasing force of the spring. For example, the stop 313 may contact the trigger guard portion 120 when the lever arm 302 is in the magazine securing position.

The release lever 300 may include a lever extension 314 that may be mounted to the effort arm portion 308. The lever extension 314 is similar to the lever extension 190 discussed above. The lever extension 314 includes an attachment portion 316 which may be mounted to the effort arm portion 308 of the lever arm 302. The effort arm portion 308 includes an attachment slot 318 sized to receive the attachment portion 316 of the lever extension 314 therein. The attachment slot 318 may be on the rear side of the lever arm 302, opposite that of the lever arm 119. The attachment portion 316 of the lever extension 314 may be slid into the attachment slot 318 to connect the lever extension 314 to the lever arm 302. The effort arm portion 308 includes a threaded opening 322 into which a fastener (e.g., a screw) may be extended to engage the attachment portion 316 of the lever extension 314 to secure the lever extension 314 to the lever arm 302. The attachment portion 316 of the lever extension 314 includes notches 320 and the fastener may extend into one of the notches 320 to secure the lever extension 314 to the lever arm 302. For instance, the fastener may be extended through the opening 322 and into the notch 320 of the lever extension 314 to inhibit the lever extension 314 from being withdrawn from the attachment slot 318.

When the attachment portion 316 of the lever extension 314 is secured to the lever arm 302, an arm portion 324 of the lever extension 314 extends in part toward the rear of the firearm 102 to support an engagement portion 326 of the lever extension 314 proximate to the trigger 130. The engagement portion 326 may extend outward of the firearm 102 from the arm portion 324 to provide an engagement surface 328 against which the user can press to pivot the lever arm 302. The engagement surface 328 may include grip features, such as stippling or cross-hatching, to increase the friction of the surface the user engages when pressing the lever extension 314. For example, the grip features inhibit the user's finger from slipping on the lever extension 314 as the user presses the lever extension 314.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A magazine release lever apparatus comprising:

an engagement portion to engage a portion of an ammunition magazine to secure the ammunition magazine to a firearm, a lever arm extending from the engagement portion, the lever arm pivotable about a pivot axis to move the engagement portion between a magazine securing position and a magazine release position, the lever arm to be adjustably mounted to the firearm to permit adjustment of a position of the engagement portion relative to the pivot axis; and an adjustment block pivotably connected to the firearm, the lever arm connected to the adjustment block to pivot with the adjustment block, the lever arm movable relative to the adjustment block and the pivot axis to permit adjustment of the position of the engagement portion.

2. The magazine release lever apparatus of claim 1 wherein the lever arm is adjustably connected to a trigger guard of the firearm.

3. The magazine release lever apparatus of claim 1 wherein the lever arm includes a recess receiving at least a portion of the adjustment block.

4. The magazine release lever apparatus of claim 1 further comprising an adjustment screw threadingly engaging the adjustment block such that rotation of the adjustment screw moves the lever arm relative to the adjustment block.

5. The magazine release lever apparatus of claim 1 further comprising a mounting bracket to attach to a firearm, the mounting bracket including a first side flange spaced from a second side flange, the lever arm disposed between the first side flange and second side flange and pivotably connected to the first side flange and second side flange.

6. The magazine release lever apparatus of claim 1 further comprising a spring biasing the lever arm to the magazine securing position.

7. The magazine release lever apparatus of claim 1 further comprising a first stop to limit movement of the lever arm from the magazine release position toward the magazine securing position, the first stop being adjustable to set a first stop position of the lever arm.

8. The magazine release lever apparatus of claim 7 wherein the first stop includes an adjustable screw threaded to the lever arm.

9. The magazine release lever apparatus of claim 7 further comprising a second stop to limit movement of the lever arm from the magazine securing position toward the magazine release position, the second stop being adjustable to set a second stop position of the lever arm.

10. The magazine release lever apparatus of claim 1 further comprising a lever extension connected to the lever arm and having a lever engagement portion, the lever extension to support the lever engagement portion proximate a trigger of a firearm.

11. The magazine release lever apparatus of claim 10 wherein the lever arm includes an attachment slot and the lever extension includes an attachment portion slidably inserted into the attachment slot to connect the lever extension to the lever arm.

12. The magazine release lever apparatus of claim 1 in combination with a firearm, the firearm comprising a magazine receiver having an opening to receive a magazine and a magazine seating portion adjacent the opening, wherein adjustment of the engagement portion of the lever arm relative to the pivot axis adjusts a size of a gap between the engagement portion and the magazine seating portion of the magazine receiver.

13. A method of installing a magazine release lever to a magazine receiver of a firearm, the magazine receiver having an opening to receive a magazine and a magazine seating portion adjacent the opening, the method comprising:

mounting the magazine release lever to the magazine receiver at the opening of the magazine receiver;

adjusting a position of the magazine release lever relative to the magazine receiver to adjust a size of a gap between the magazine release lever and the seating portion; and wherein adjusting the position of the magazine release lever includes shifting the entire magazine release lever relative to a pivot axis of the magazine release lever.

14. The method of claim 13 wherein adjusting the position of the magazine release lever includes rotating an adjustment screw to shift the magazine release lever toward or away from the seating portion of the magazine receiver.

15. The method of claim 14 wherein the firearm includes a trigger guard coupled to the magazine receiver, wherein the adjustment screw engages an adjustment block pivotably connected to the trigger guard such that rotating the adjustment screw shifts a position of the magazine release lever relative to the pivot connection of the adjustment block.

16. The method of claim 13 wherein the magazine release lever is pivotable between a magazine securing position and a magazine release position, the method further comprising adjusting a stop to limit movement of the magazine release lever from the magazine release position to the magazine securing position or from the magazine securing position to the magazine release position.

17. The method of claim 13 wherein mounting the magazine release lever to the magazine receiver includes securing the magazine release lever to a trigger guard of the firearm.

18. A magazine release lever apparatus comprising:

a lever arm having an engagement portion at a first end of the lever arm, the engagement portion to engage a portion of an ammunition magazine to secure the ammunition magazine to a firearm, a mounting portion of the lever arm to be pivotably mounted to the firearm to permit the lever arm to pivot about a pivot axis and to move the engagement portion between a magazine securing position and a magazine release position;

an effort arm portion of the lever arm extending from the mounting portion opposite the engagement portion;

a lever extension attachable to the effort arm portion of the lever arm, the lever extension having a lever engagement portion, the lever extension to support the lever engagement portion proximate a trigger of a firearm; and wherein the effort arm portion includes an attachment slot and the lever extension includes an attachment portion slidably inserted into the attachment slot to connect the lever extension to the lever arm.

* * * * *